US010408559B2

(12) United States Patent
Schuster et al.

(10) Patent No.: US 10,408,559 B2
(45) Date of Patent: Sep. 10, 2019

(54) ARCHERY CROSSBOW PORTABLE PRESS

(71) Applicant: Specialty Archery, L.L.C., Spencer, IA (US)

(72) Inventors: Allan Richard Schuster, Spencer, IA (US); Charles Edward Horn, Cedar Rapids, IA (US)

( * ) Notice: Subject to any disclaimer, the term of this patent is extended or adjusted under 35 U.S.C. 154(b) by 0 days.

(21) Appl. No.: 16/142,110

(22) Filed: Sep. 26, 2018

(65) Prior Publication Data

US 2019/0101353 A1 Apr. 4, 2019

Related U.S. Application Data

(60) Provisional application No. 62/568,080, filed on Oct. 4, 2017.

(51) Int. Cl.
*F41B 5/14* (2006.01)
*F41B 5/12* (2006.01)

(52) U.S. Cl.
CPC ..... *F41B 5/12* (2013.01); *F41B 5/1449* (2013.01)

(58) Field of Classification Search
CPC ..... F41B 5/14; F41B 5/1449
USPC ..... 124/1, 25, 86
See application file for complete search history.

(56) References Cited

U.S. PATENT DOCUMENTS 4,077,385 A * 3/1978 Fredrickson ..... F41B 5/10 124/25.6
4,291,452 A * 9/1981 Whitman, Sr. ..... F41B 5/1449 124/23.1
4,599,987 A * 7/1986 Rezmer ..... F41B 5/1449 124/23.1
5,125,389 A * 6/1992 Paff ..... F41B 5/1449 124/23.1
5,425,350 A * 6/1995 Egusquiza ..... F41B 5/1449 124/1
5,746,192 A * 5/1998 Gissel ..... F41B 5/14 124/1
5,823,172 A * 10/1998 Suggitt ..... F41B 5/12 124/25
5,957,120 A * 9/1999 Wiseby ..... F41B 5/14 124/86
6,913,007 B2 * 7/2005 Bednar ..... F41B 5/123 124/25
7,980,235 B1 * 7/2011 Kronengold ..... F41B 5/14 124/1
8,499,753 B2 * 8/2013 Bednar ..... F41B 5/123 124/25
8,733,333 B2 * 5/2014 Barrios ..... F41B 5/1449 124/1

(Continued)

*Primary Examiner* — Alexander R Niconovich
(74) *Attorney, Agent, or Firm* — Briggs and Morgan P.A.; Gerald E. Helget

(57) ABSTRACT

A portable, compact, collapsible, adjustable, archery crossbow press for high poundage crossbows which have a rifle-like frame with an elongate channel and transverse limbs with outwardly located cams or wheels connected by a bow string. The crossbow press includes two limb clamp assemblies that releasably capture the transverse limbs about the cams. A flexible connector connects the two limb clamp assembles just above the rifle-like frame. A safety hook block fits within the elongate channel rearwardly of the crossbow string and is anchored to the rifle-like frame. A mechanical cocking device pulls the flexible connector rearwardly to secure it to a hook on the anchored safety hook block.

9 Claims, 10 Drawing Sheets

(56) References Cited

U.S. PATENT DOCUMENTS

| | | | | |
|---|---|---|---|---|
| 8,991,372 | B2 * | 3/2015 | Pirillo | F41B 5/1449 124/1 |
| 2004/0129260 | A1 * | 7/2004 | Evans | F41B 5/1449 124/1 |
| 2004/0194770 | A1 * | 10/2004 | Johnson | F41B 5/10 124/1 |
| 2006/0086346 | A1 * | 4/2006 | Middleton | F41B 5/12 124/25 |
| 2009/0293854 | A1 * | 12/2009 | Evans | F41B 5/10 124/86 |
| 2013/0174823 | A1 * | 7/2013 | Pulkrabek | F41B 5/1449 124/86 |
| 2014/0060513 | A1 * | 3/2014 | Tulpa | F41B 5/1449 124/86 |
| 2014/0069407 | A1 * | 3/2014 | Barrios | F41B 5/1449 124/86 |
| 2018/0266786 | A1 * | 9/2018 | McPherson | F41B 5/1449 |

* cited by examiner

ARCHERY CROSSBOW PORTABLE PRESS

BACKGROUND OF THE INVENTION

The present invention relates to a portable, compact, adjustable, collapsible archery bow press for high poundage crossbows.

Crossbows have been around for centuries going back to middle ages. In most cases they replaced archery bows when the former archers had muscular or skeletal injuries which prohibited them from pulling and holding the bow back to fully loaded position ready for release of an arrow. Also, because crossbows are easily aimed, a novice or an elderly person may accurately shoot a crossbow without any previous archery experience.

Today crossbows are of a much higher poundage than most bows and are extremely accurate. FIG. 1 shows a modern crossbow 10 which may have a poundage of 180-200 pounds. The crossbow 10 has a rifle-like frame 12 with transverse limbs 14. The limbs 14 are fastened to the frame with permanent, fixed limb pockets 16. Cams or wheels 18 extend outwardly from the limbs 14 around which is wrapped the cable or bow string 20. At the front of the crossbow extending forwardly is an optional stirrup 22 for placing one's foot therein for cocking the crossbow string 20 with hands and fingers, after which an arrow or bolt 24 is loaded into position for shooting. Thereafter, the crossbow 10 shoots much like a rifle.

FIG. 2 shows a modern crossbow 26 with reverse limbs which also may have a poundage of 180-200 pounds. The crossbow 26 has a rifle-like frame 12 with transverse reversed limbs 14. The limbs 14 are fastened to the frame with permanent, fixed limb pockets 16. Cams 18 extend outwardly from the limbs 14 around which is wrapped the cable or bow string 20. At the front of the crossbow extending forwardly is a stirrup 22 for placing one's foot therein for cocking the crossbow string 20, after which an arrow or bolt 24 is loaded into position for shooting. Thereafter, the crossbow 26 shoots much like a rifle.

Crossbows are cocked to their firing position by hand or use of a mechanical cocking device such as a cord with hooks on the cord's ends or cranked rack-and-pinion or worm gear/drive devices built into the rifle-like frame.

Because a compound bow cannot be conveniently unstrung and restrung, they are virtually always left in a strung condition. However, periodic retuning of compound bows is often required to maintain desired performance levels, and to change, replace or repair components of the compound bow, such as the bow string, string sights, dampers, the tension cable, the cams and other components.

Referring to FIG. 3, through the years a number of bow presses 30 have been developed for facilitating stringing, tuning, and maintenance of compound bows 32 and crossbows 10, 26. Such bow presses require a work bench and are typically found only in bow shops. In general, these presses 30 have included a stationary base 34 having a pair of spaced apart inside surface supports, in the form of pegs or rollers 36, for contacting the inside of the bow 32. A pair of outside limb supports, in the form of pegs or rollers 38, are attached to a moveable mechanism for applying a bending force to the limbs of the bow 32. Several problems have been noted with regard to prior bow presses 30.

Prior stationary bow presses 30 can damage the bow 32 or crossbow 10, 26, particularly when operated by inexperienced personnel. It is very important that the inside surface supports 36 and the outside limb supports 38 of the bow press 30 be precisely positioned in such a manner that the bow 32 or crossbow 10, 26 is properly loaded into the press 30 in such a manner that the limbs are bent in a way that will not overstress or otherwise damage the bow 32 or crossbow 10, 26. Because compound bows 32 and crossbows 10, 26 vary dimensionally, from one model or manufacturer to another, it is necessary that the inside surface support 36 and the outside limb supports 38 on the bow press 30 be adjustable. In the past, it has been customary to provide incremental holes in the bow press 30 so that the position of the inside surface supports 36 and the outside limb supports 38, or other components of the bow press 30, could be moved to achieve a best fit with regard to a given bow 32 or crossbow 10, 26. The incremental nature of this adjustment approach often results in a fit of the bow press 30 to the bow 32 or crossbow 10, 26 which is not quite ideal, and can result in damage to the bow or crossbow. This is especially problematic where personnel operating the bow press 30 lack experience and knowledge.

It is also generally necessary that the stationary bow press 30 be adjusted in a manner that results in a symmetrical positioning of the inside surface supports and the limb supports with respect to the center of the bow handle. Prior bow presses do not provide a convenient means of achieving this symmetry.

Prior bow presses 30 are also not easy to adjust, in that the incrementally movable components are typically bolted to the bow press, thereby requiring the use of the wrenches or other tools for making the necessary adjustments.

The limbs of the bow can also be damaged, even when the bow press is properly adjusted, by the use limb supports that must slide or roll along the limb as it is bent in the bow press. Such rolling or sliding supports can cause marring and other physical damage to the limbs.

In some prior bow presses, it is also possible, under some conditions, for the limb supports to be moved to a position along the limbs where the bow will become locked into the bow press. This typically results in significant damage to the bow, and can create a potentially hazardous condition for personnel operating the bow press, as they attempt to remove the bow from the press. In such situations, it may even be necessary to partly disassemble the bow press to get the bow out of the press. The bow limbs will have considerable energy stored in them, which could cause them to spring outward dangerously when parts of bow press are removed to release the bow from the press.

It is desirable, therefore, to provide an improved portable, compact, adjustable, collapsible archery bow press for high poundage crossbows which overcomes one or more of the problems described above and is useable in the field or outside of an archery bow shop which additionally overcomes all the problems and shortcomings of prior bow presses.

SUMMARY OF THE INVENTION

A portable, compact, collapsible, adjustable, archery crossbow press for high poundage crossbows which have a rifle-like frame with an elongate channel, transverse limbs with outwardly located cams or wheels connected by a bow string. The crossbow press includes two limb clamp assemblies that releasably capture the transverse limbs about the cams. A flexible connector connects the two limb clamp assemblies just above the rifle-like frame. A safety hook block or fits within the elongate channel rearwardly of the crossbow string and is anchored to the rifle-like frame. A mechanical cocking device pulls the flexible connector rearwardly to secure it to a hook on the anchored safety hook block. Crossbows with a crank-type cocking device utilize a slide moveable within the elongate channel to capture and pull the flexible connector into a rearward locked position. In this condition, the bow string, string sights, dampers, tension cable, cams and other components may be safely worked on or replaced.

A principal object and advantage of the present invention is that the bow press is portable, compact, collapsible, easily stored in a small hand bag and relatively cheap compared to bench mounted bow presses.

Another principal object and advantage of the present invention is that the bow press is adjustable to fit any number of different models and manufactured crossbows.

Another principal object and advantage of the present invention is that the bow press is operable in the field without a need to secure the bow press to a bench or take the crossbow to a bow shop.

Another principal object and advantage of the present invention is that the bow press is extremely simple and safe to use even by archers who lack experience and knowledge of bow presses.

DETAILED SPECIFICATION

Figure 1:
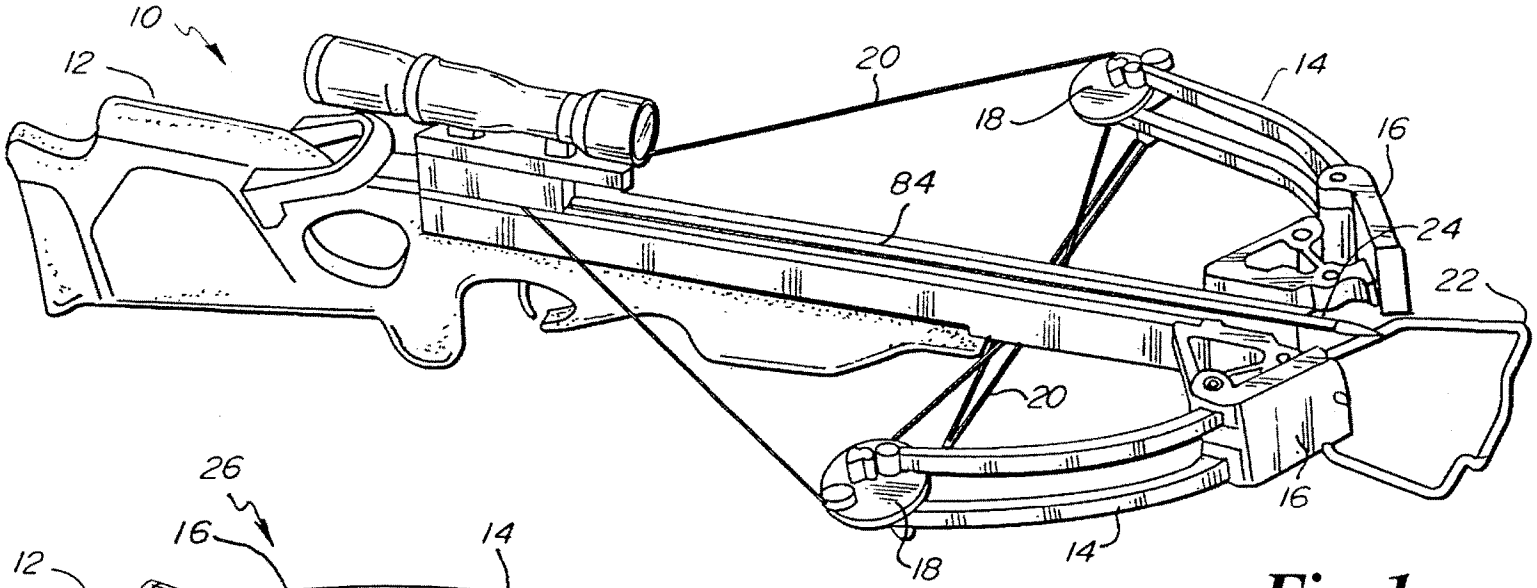
Fig. 1 (PRIOR ART)
FIG. 1 is a perspective view of a cocked modern crossbow.
Figure 2:
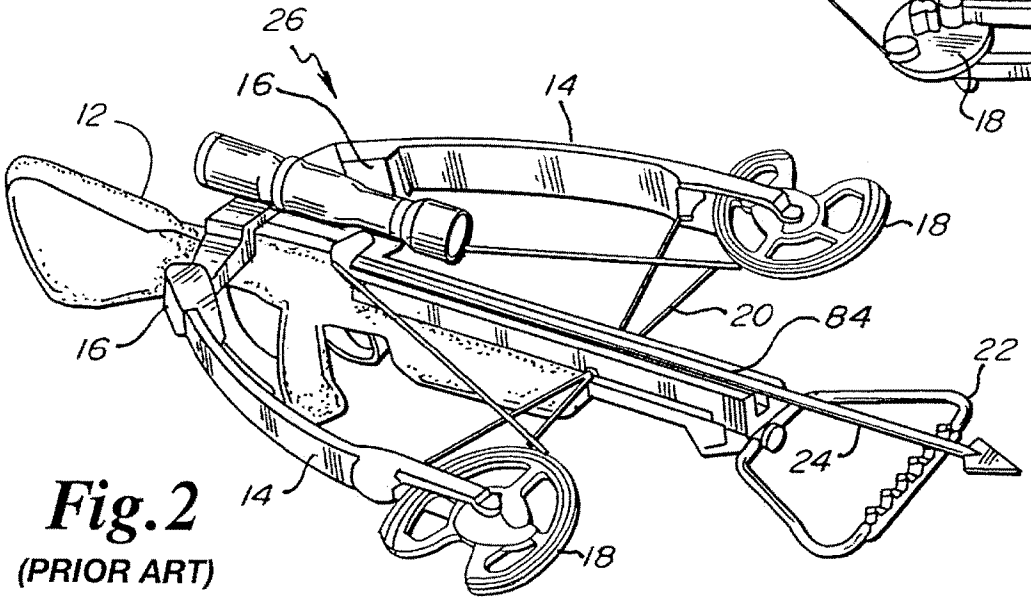
Fig. 2 (PRIOR ART)
FIG. 2 is a perspective view of a cocked modern crossbow with reverse limbs.
Figure 3:
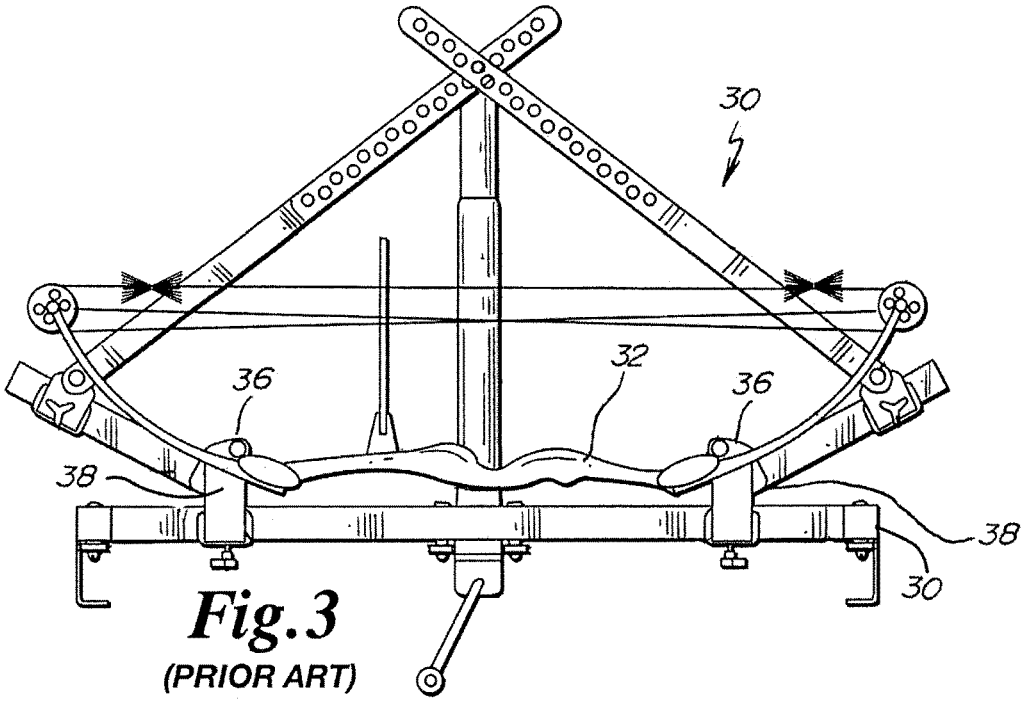
Fig.3 (PRIOR ART)
FIG. 3 is front elevational view of a stationary bow press with a modern archery bow mounted therein.
Figure 4:
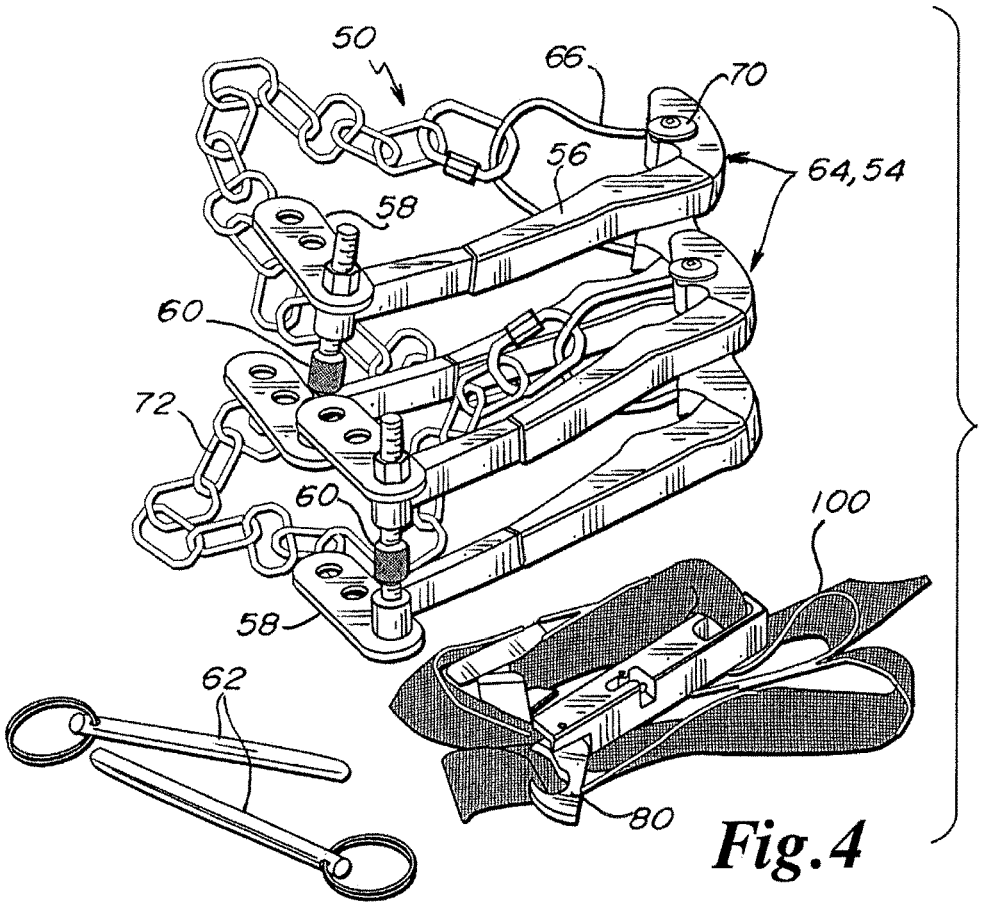
FIG. 4 is a perspective view of the portable, compact, adjustable, collapsible archery bow press of the present invention in compact disassembled condition for easy storage and transportation.
Figure 5:
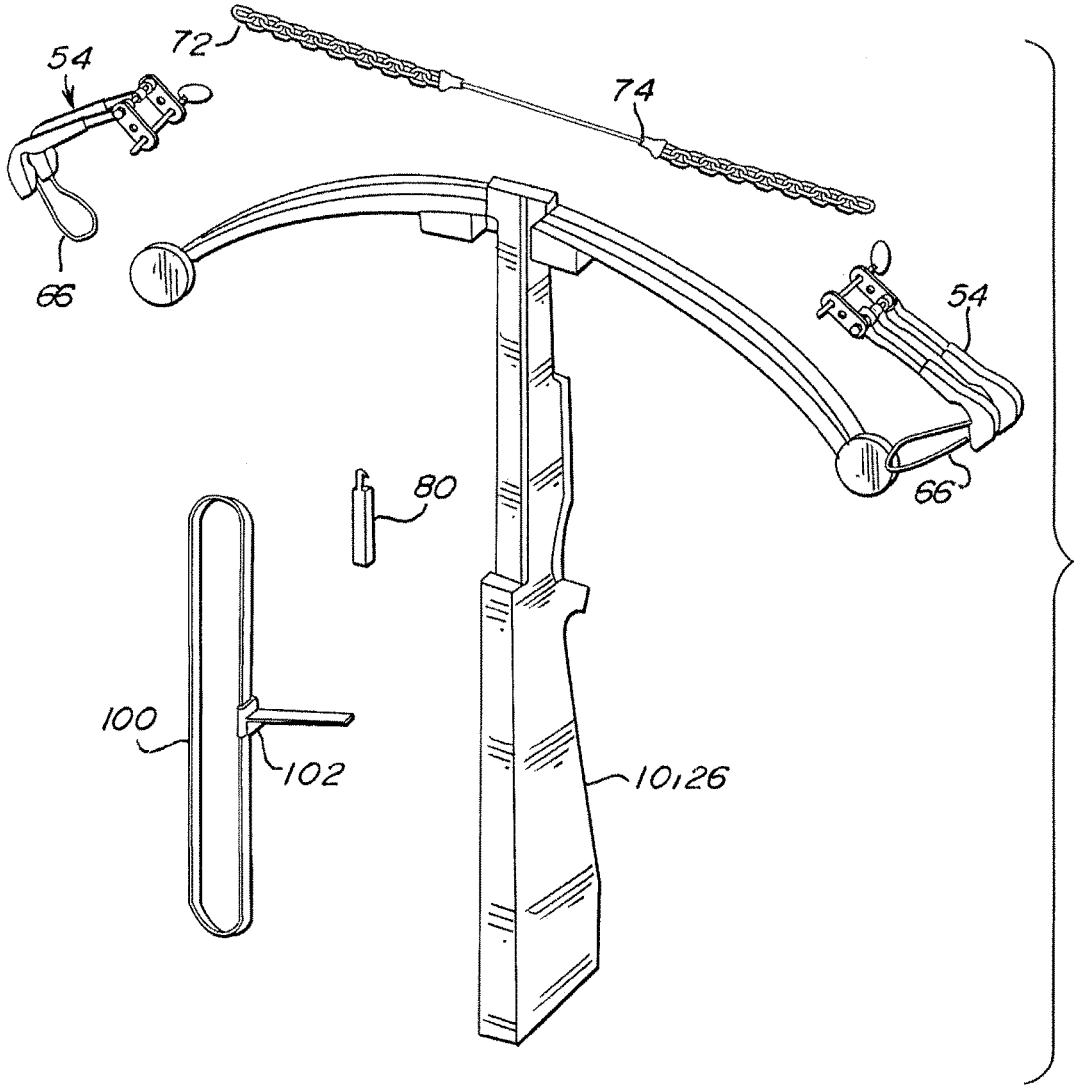
FIG. 5 is a front perspective view of a crossbow with the bow press of the present invention with an exploded view of the bow press adjacent to its positioning on the crossbow.

Referring to FIGS. 4 through 7, the detail of the parts of the portable, compact, collapsible, adjustable, archery crossbow press 50 for high poundage crossbows 10, 26 may be appreciated. The bow press includes two identical limb clamp assemblies 54 which are interchangeable.

The parts of the two limb clamp assemblies 54 are identical. Therefore, a single clamp assembly 54 will be described in detail as such applies to both clamp assemblies 54.

Clamp assembly 54 has two outer arms 56. Each outer arm 56 has one end having an adjustable first dog bone linkage 58 with apertures for pivotal connecting to the outer arm 56 with a turnbuckle arrangement 60. At the other end of linkage 58 is a quick release pin 62. The pin 62 can be located in any of the apertures on the linkage 58 to make the clamp assemblies 54 adjustable as they are fit about the limb 14 end of a variety of different crossbows. Particularly, the outer arms 56 may have their lateral distance from each other adjusted by adjusting the turnbuckle 60 as to fit bow limbs 14 of a variety of widths.

Opposite the first linkage 58, at the opposite end of outer arm 56, is located a bent elbow end 64 which receives one of the ends of the bow limb 14. At this location is a limb end centering washer or tab 70. The bent elbow end 64 has a cord aperture 65. Flexible cord 66 passes through aperture 65 and the aperture 65 of the adjacent and parallel outer arm 56 of the associated limb clamp assembly 54. Thereafter, the ends of cord 66 have their ends knotted 68 to secure the cord 66 to its associated adjacent and parallel outer arms 56 of each limb clamp assembly 54. The flexible cord 66 is connected to one of the short chain links 72 of the flexible connector 71 suitably with an openable chain link connector. The other end of the chain 72 is permanently connected to a flexible cord 74 (similar to cord 66). Cords 66 and 74 may be obtained from Samson Rope Technologies, Inc. of Ferndale, Wash. marketed under the trademark AMSTEEL® and have qualities of wire rope.

Figure 6:
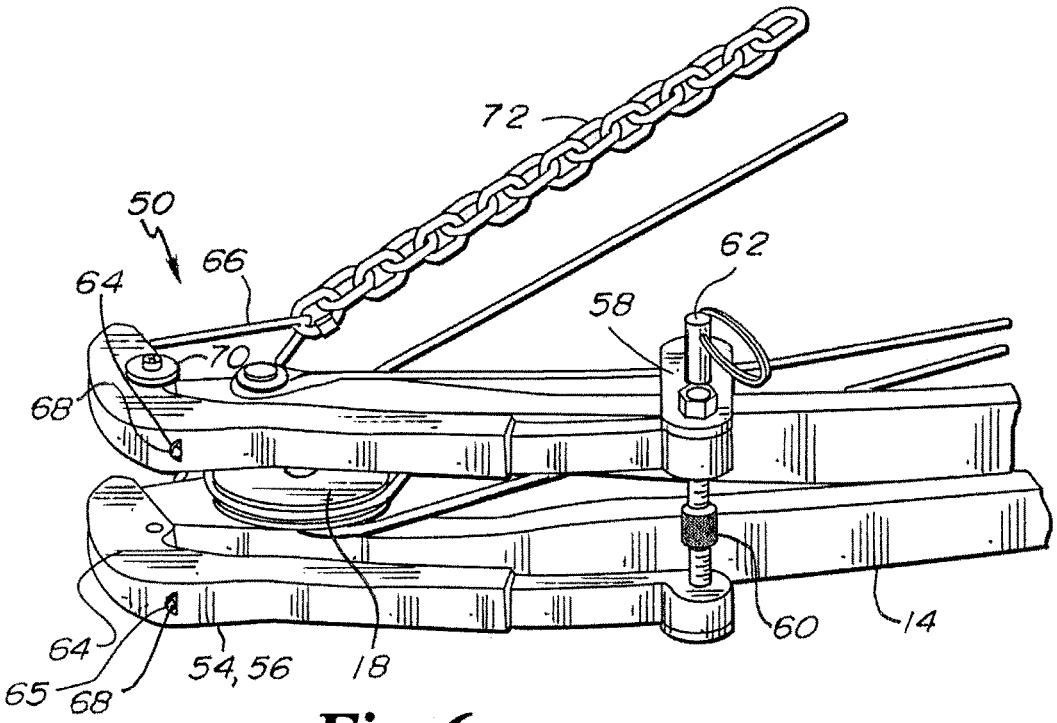
FIG. 6 is a broken away perspective view of one of the limb clamp assembly mounted over one of the cams on one limb.
Figure 7:
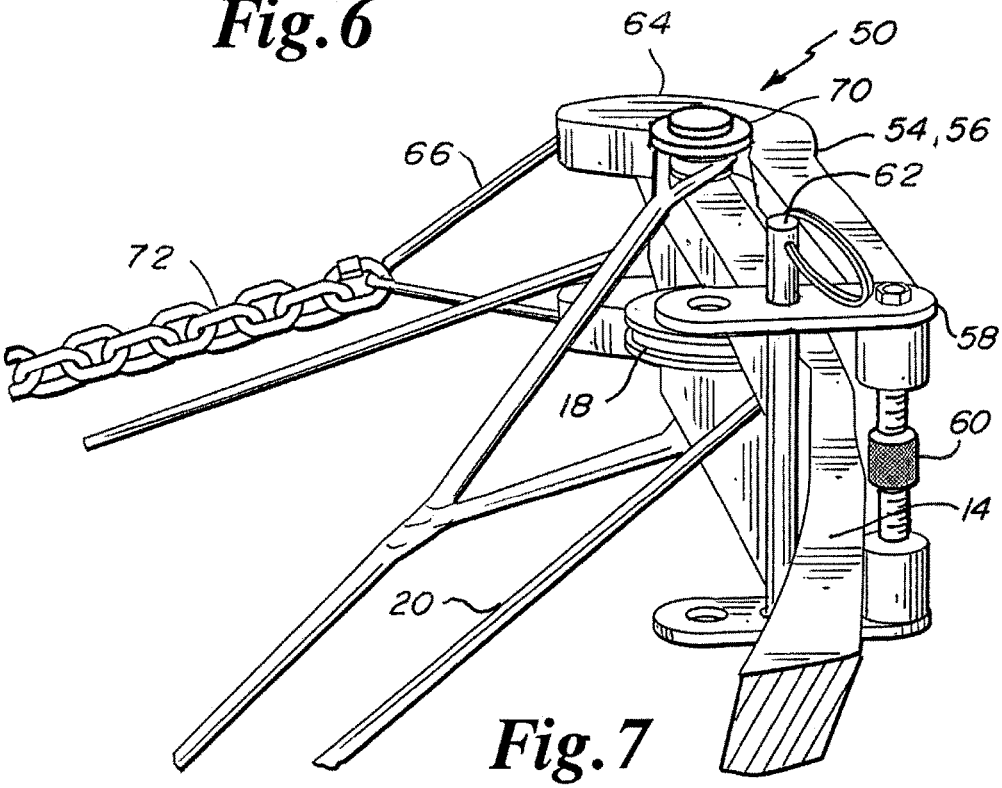
FIG. 7 is a broken away perspective view of the other limb clamp assembly mounted over the other cam on the other limb.

FIGS. 6 and 7 show how the identical limb clamp assemblies 54 are secured about the cams 18 on limbs 14. The bent elbow ends 64 of one assembly 54 are fitted over the limb end and aligned with the assistance of centering washer 70. The lateral spacing between the outer arms 56 is adjusted by way of adjusting the turnbuckle 60. Pins 62 are then inserted into the dog bone linkage 58 to securely fasten the limb clamp assembly 54 to the crossbow limb 14. The chain link connector of the flexible connector or cord 74 is opened and captures the flexible cord 66 on the clamp assembly 54. The length of the flexible connector 74 may be adjusted by moving the chain link connector to a different chain link 72.

Figure 8A:
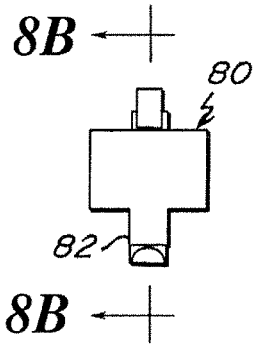
FIG. 8B is a cross sectional view of the safety hook block taken along lines B-B of rear end view in FIG. 8A.
Figure 8B:
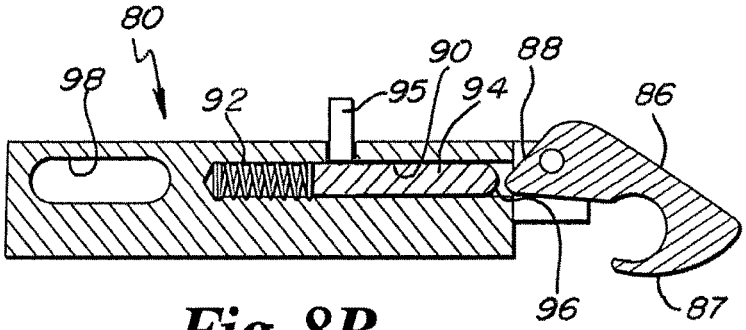
Figure 9A:
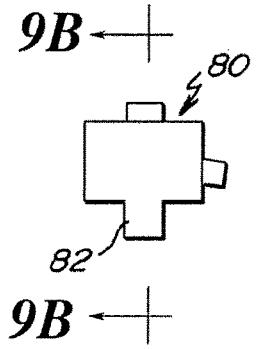
FIG. 9B is a cross sectional view of the safety hook block taken along lines B-B of rear end view in FIG. 9A.
Figure 9B:
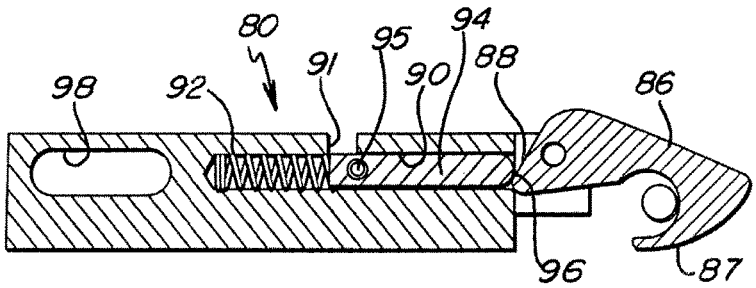
Figure 10A:
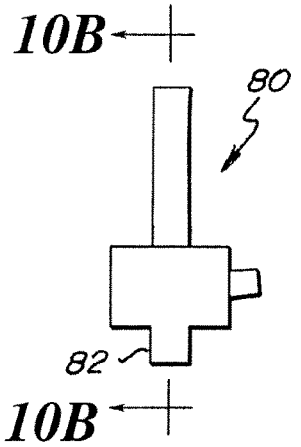
FIG. 10B is a cross sectional view of the safety hook block taken along lines B-B of rear end view in FIG. 10A.
Figure 10B:
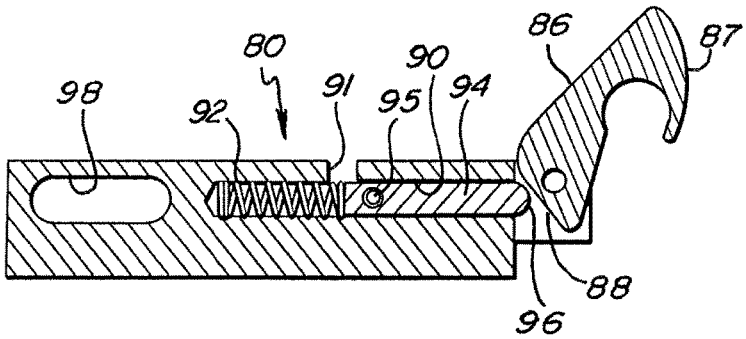
Figure 11:
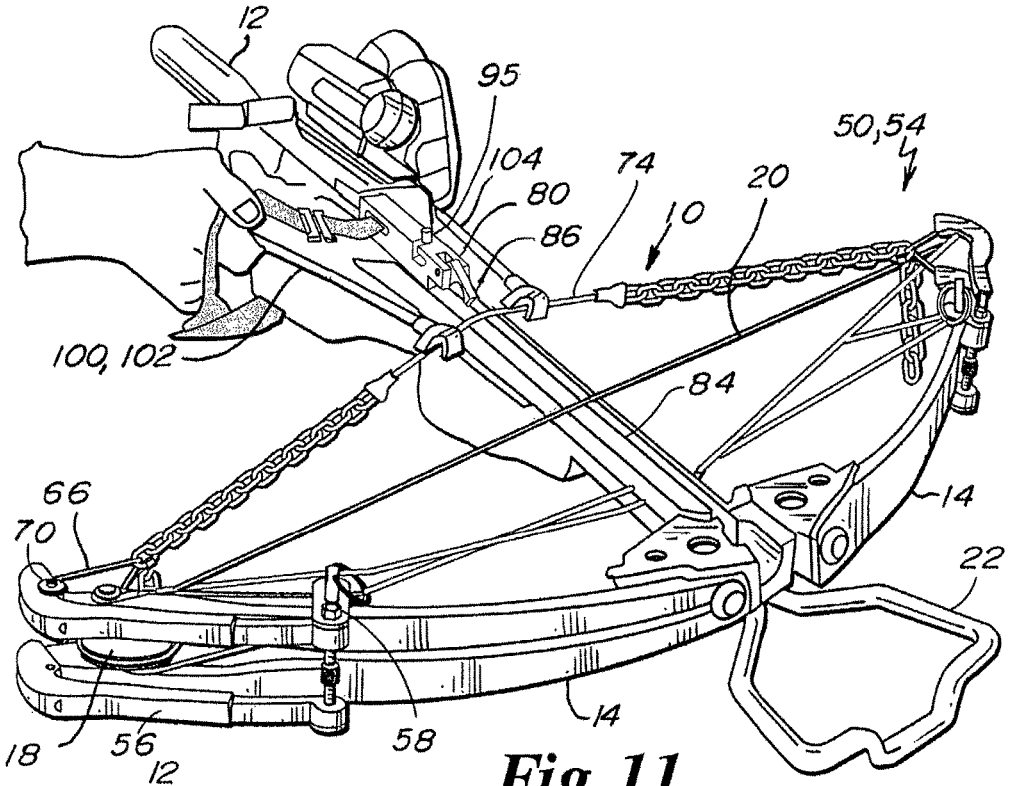
FIG. 11 is a perspective view of the crossbow press mounted on a crossbow with the operator pulling rearwardly on a mechanical cocking cord with hooks connected to the flexible connector.

Referring to FIGS. 8 through 10, the safety hook block 80, which captures and releases the flexible connector 71, may be appreciated in detail. The block 80 has a rail 83 on its bottom side as to fit within the elongate channel 84 on the top of the rifle-like frame 12 of crossbows 10, 26 (see also FIG. 11). At the front end of the safety hook block 80 is pivotally mounted hook 86. Hook 86 has a front ramp for sliding and lifting engagement with the flexible woven cord 74 of the flexible connector 71. A cam surface 88 is also provided as explained below. Within the block 80 is an internal cylindrical chamber 90. A pin slot 91 and channel 93 are open into the chamber 90. At the rear of chamber 90 and captured therein is located a coil spring 92. Forward of spring 92 is located a captured cylindrical ram 94 with a round forward end 96. Ram 94 slideably moves longitudinally within chamber 90 and is generally urged forwardly under the influence of spring 92. Actuator pin 95 is fastened to ram 94 and is moveable up and down within pin slot 91 and forward and rearward within channel 93.

At the rear end of safety hook block 80 is an enclosed channel or passageway 98 for capturing flexible strap 100 which anchors the block 80 siting in the channel 84 to the rifle-like frame 12 suitably through the trigger guard and is secured tightly in place by a clasp or buckle 102.

Operation of the safety hook block is shown in FIGS. 8 through 10. With the actuator pin 95 in is upright position extending upwardly from pin slot 91, the pivotal hook 86 is free to move upwardly or downwardly. The downward position is the hook's 86 rest position. When the flexible cord 74 moves against the front ramp 87 of hook 86, the hook has a tendency to pivot upwardly to let the flexible cord 74 pass thereby. Thereafter the hook 86 falls back downwardly to its rest position and thereafter the operator relaxes his pulling on the mechanical cocking device or pull straps 104 which will secure the flexible cord 74 to seat within the hook 86. Thereafter the operator may work on the crossbow 10, 26 with the bow string 20 in a relaxed and limp condition.

Figure 12:
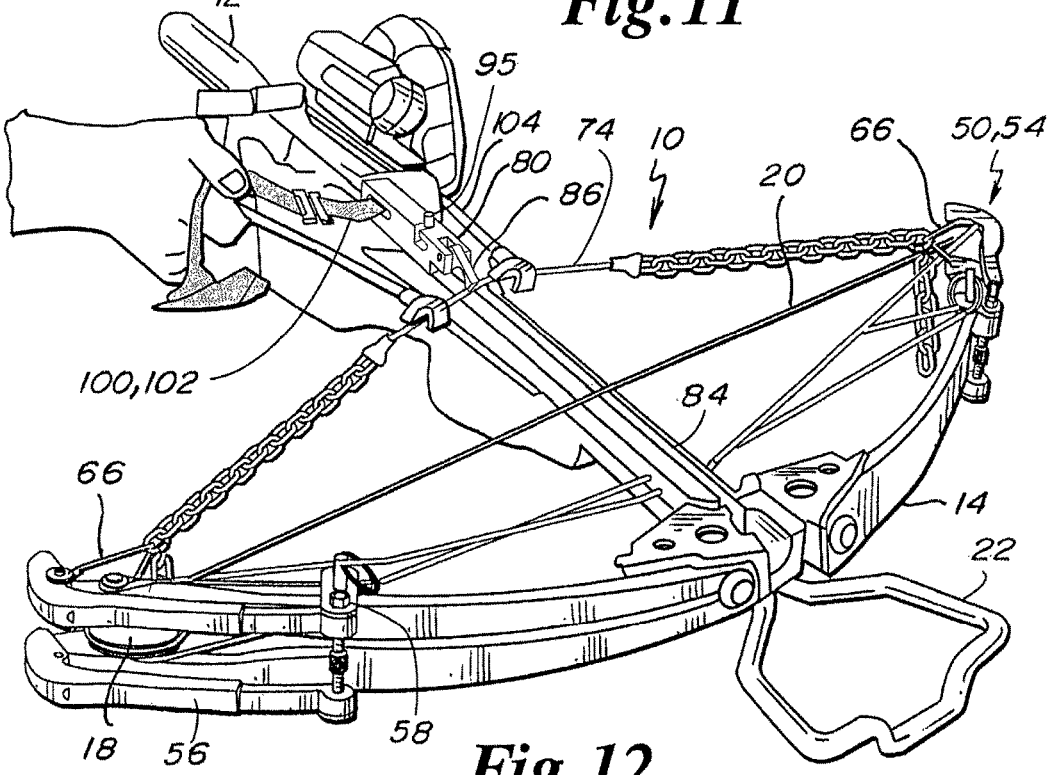
FIG. 12 is a perspective view of the crossbow press mounted on a crossbow with the flexible connector captured by the hook on the anchored hook block.
Figure 13:
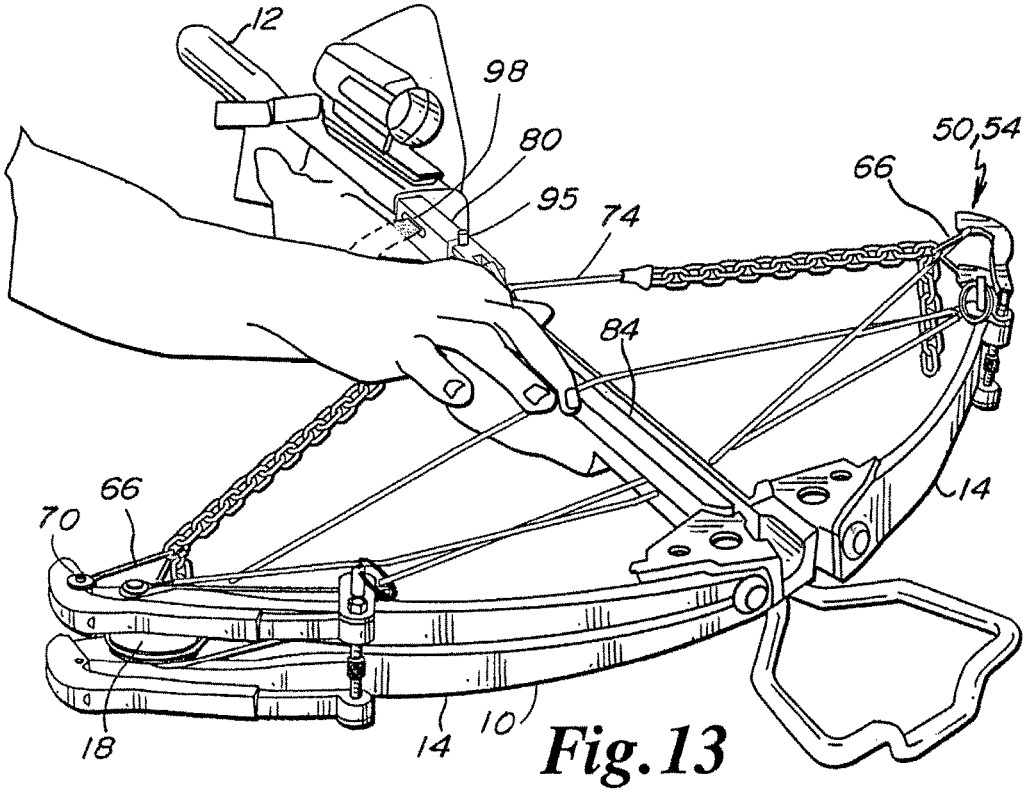
FIG. 13 is a perspective view of the crossbow press mounted on a crossbow with the flexible connector captured by the hook on the anchored hook block and the operator touching the loose bow string.
Figure 14:
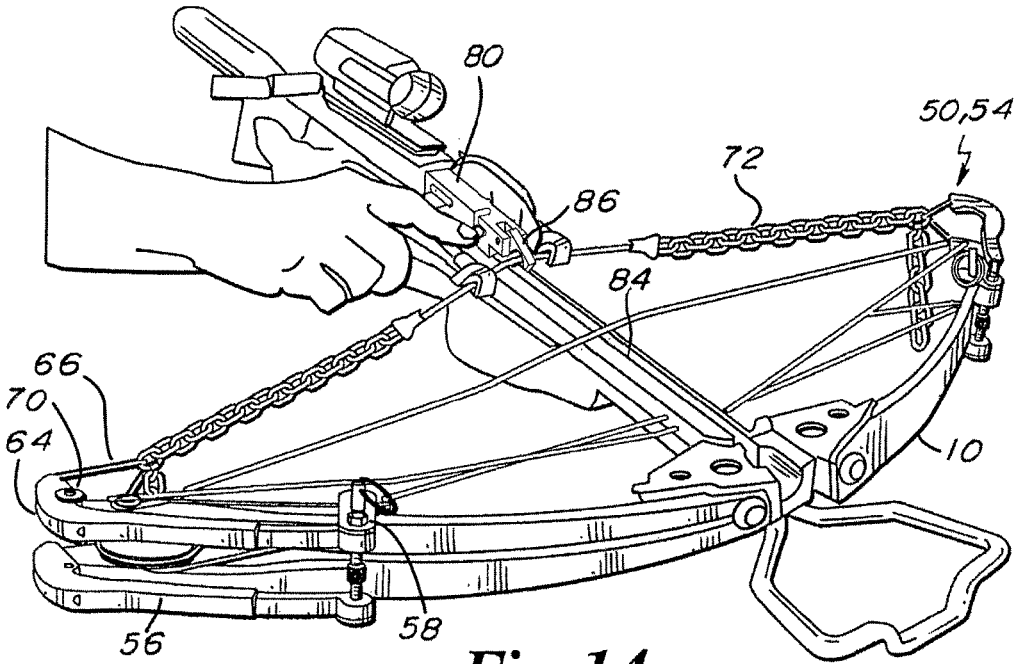
FIG. 14 is a perspective view of the crossbow press mounted on a crossbow with the operator toggling the actuator pin on the safety hook block for lifting the hook on the anchored hook block to begin the process of releasing the flexible connector from the safety hook block.
Figure 15:
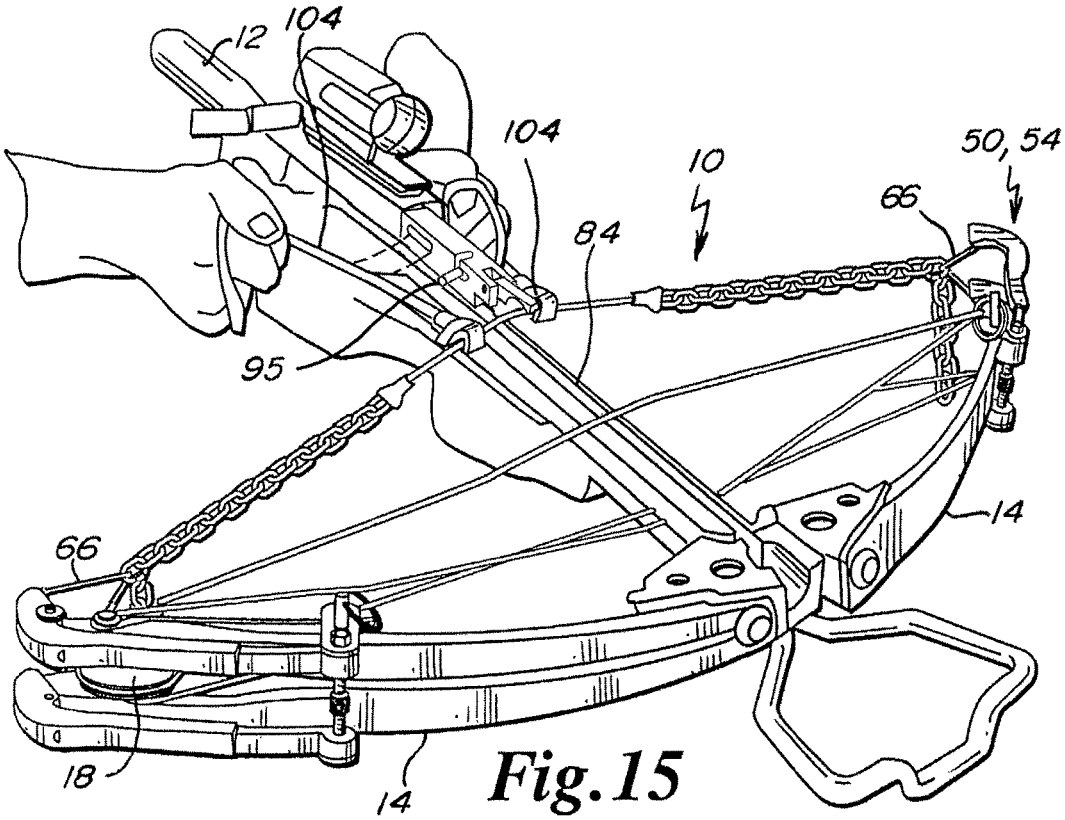
FIG. 15 is a perspective view of the crossbow press mounted on a crossbow with the operator pulling slightly rearwardly on a mechanical cocking cord to begin to complete the process of lifting the hook as to clear the flexible connector to back down the crossbow limbs.
Figure 16:
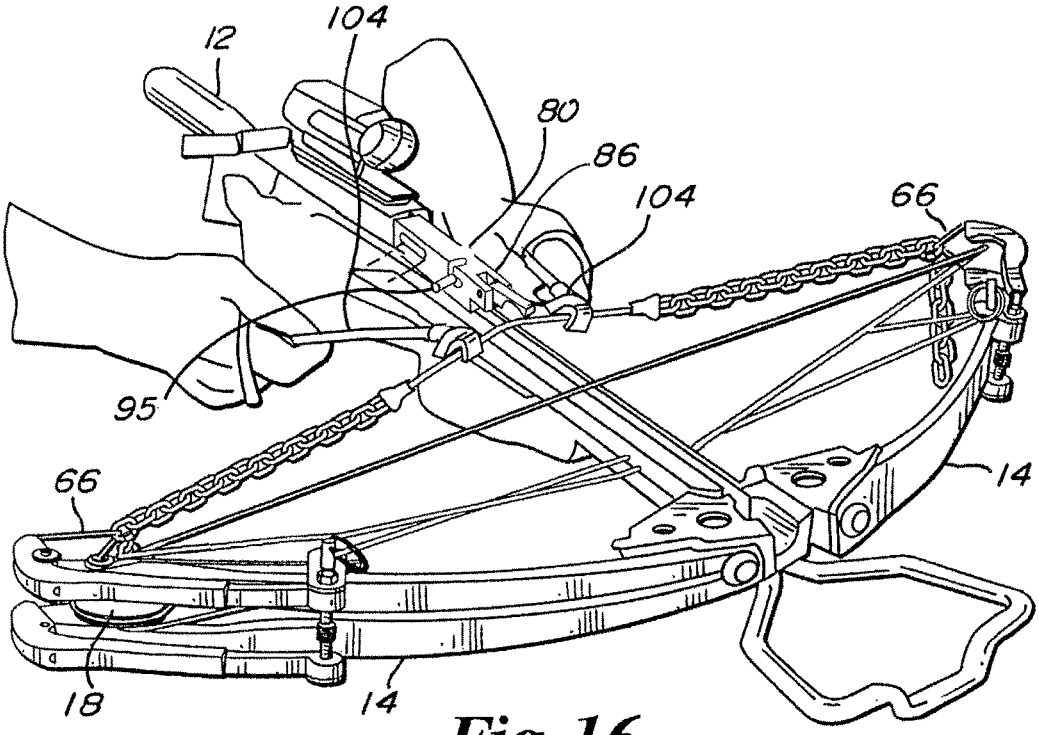
FIG. 16 is a perspective view of the crossbow press mounted on a crossbow with the operator slowly releasing the mechanical cocking cord to completely back down the crossbow limbs.

After the work is complete, the operator simply rotates the actuator pin 95 downwardly in the pin slot 91. The action of the spring 92 tends to move the ram 94 and pin 95 forwardly so that the rounded forward end 96 rests up against the cam surface 88 of the hook 86. The operator then pulls rearwardly on the mechanical cocking device 104 (FIGS. 11 and 12), to allow the ram 94 with its rounded forward end 96 under the influence of spring 92, to move the hook 86 to its uppermost position. Then the operator simply slowly relaxes the cocking device or pull strap 104 as to bring the limbs 14 outwardly to their resting state for ready use after the bow press 50 is removed from the crossbow 10, 26.

FIGS. 11 through 16 show more of the operation of the bow press 50 on a crossbow 10, 26. The crossbow press 50 is mounted on a crossbow with the flexible connector 71 pulled rearwardly to be captured by the hook 86 on the anchored hook block 80. The operator may work on the loose bow string and other crossbow components. After the work is complete, the operator toggles down the actuator pin 95 on the safety hook block 80 which allows the biased ram 94 to urge against the cam surface 88 for lifting the hook 86 on the anchored hook block 80.

To begin the process of releasing the flexible cocking connector or cord 71 from the safety hook block 80, the operator pulls slightly rearwardly on a mechanical cocking cord 71 to begin to complete the process of lifting the hook 86 as to clear the flexible connector 71 to back down the crossbow limbs. The operator continues slowly releasing the mechanical cocking cord 71 to completely back down the crossbow limbs 14.

Figure 17:
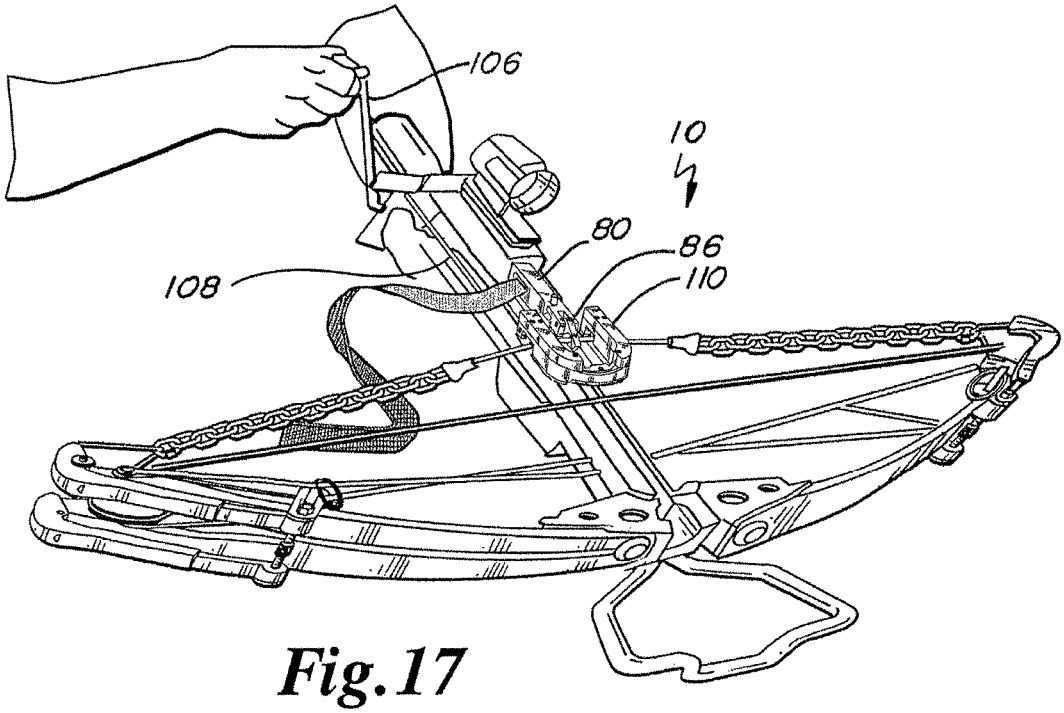
FIG. 17 is a perspective view of the crossbow press mounted on a crossbow wherein the mechanical cocking device is a cranked rack-and-pinion or worm gear/drive device suitably built into the rifle-like frame and the slide has captured the flexible connector.
Figure 18:
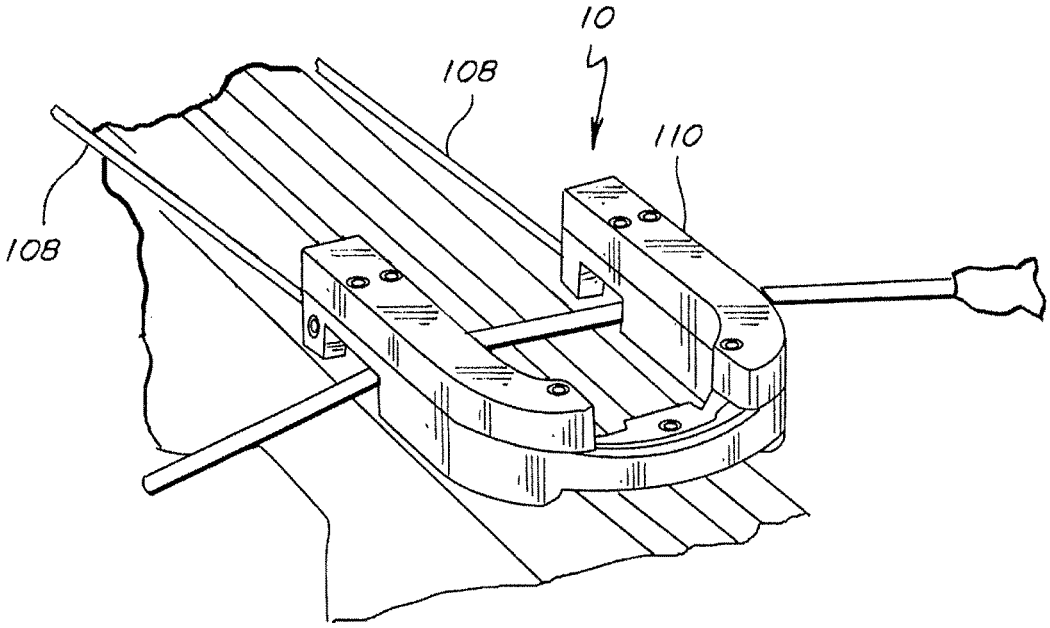
FIG. 18 is a perspective partial enlarged view of the crossbow press mounted on the crossbow of FIG. 17 wherein the slide has captured the flexible connector.

FIGS. 17 and 18 are perspective views of the crossbow press 50 mounted on a crossbow 10, 26 wherein the mechanical cocking device includes a crank 106 releaseably connected to rack-and-pinion or a worm drive/gear device (not shown) suitably built into the rifle-like frame 12. Cord 108 is connected to the crank 106 and mechanical locking device and wrapped around slide 110 situated in channel 84. When the mechanical cocking device is cranked, letting go of the crank 106 will hold the slide in place as it is situated in the channel 84. In FIG. 17, the safety hook block 80 may also be used, if desired.

FIG. 18 shows a perspective partial enlarged view of the crossbow press 50 mounted on the crossbow of FIG. 17 wherein the safety hook block 80 is not used. The worm drive/gear, suitably in the stock of the frame 12, holds the slide 110 in place as it has captured the flexible connector 71 pulled back so that the cross bow 10, 26 may be worked upon. After the work is completed, the crank 106 is turned to back the flexible connector 71 down to re-tension the crossbow. The crank 106 and slide 110 is simply removed and stored for future use.

Figure 19:
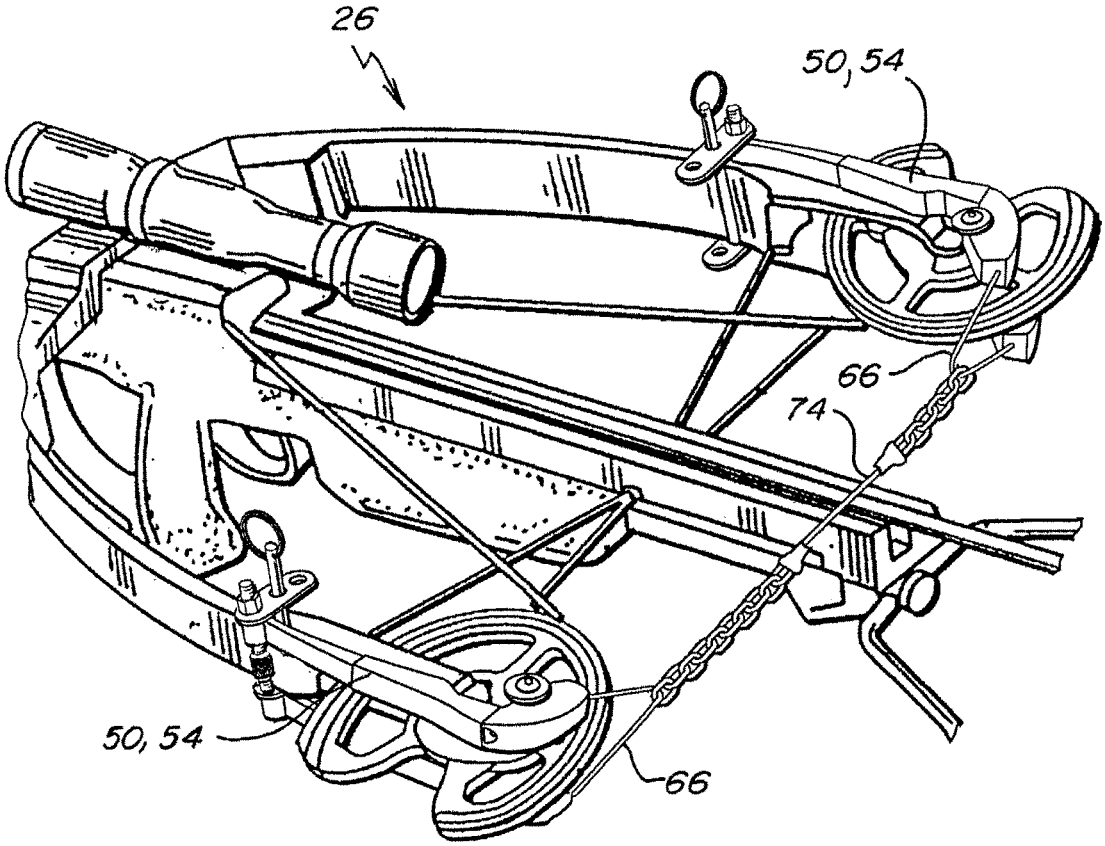
FIG. 19 is a perspective view of the crossbow press mounted on a crossbow with reverse limbs.

FIG. 19 is a perspective view of the crossbow press mounted on a crossbow with reverse limbs.

The above description and mentioned FIGS. are for illustrative purposes only. The true scope of the present invention is defined by the following claims.

What is claimed:

1. A portable, compact, collapsible, adjustable, archery crossbow press for high poundage crossbows which have a rifle frame with an elongate channel, transverse limbs with cams or wheels, outer surfaces and outer ends, dampers, a tension cable and a bow string, the bow press comprising:

a) two limb clamp assemblies each with an outer arm with a dog bone linkage and a bent elbow end which are adjustable in width as to be adaptable to fit a variety of crossbow models and manufacturers of crossbows, each limb clamp assembly being adapted to releasably capture one of the outer surfaces, ends and cams of the transverse limbs of the crossbow:

b) a flexible connector adapted to connect to the two limb clamp assembles just above the rifle frame;

c) a safety hook block with a hook adapted to fit within the elongate channel of the crossbow rearwardly of the bow string and is further adapted to be anchored to the rifle frame and the hook releasably captures the flexible connector; and d) a mechanical cocking device adapted to be attachable to the flexible connector to pull the flexible connector rearwardly along the elongate channel until the hook of the safety hook block securely captures and holds the flexible connector in place as the cams or wheels, dampers, tension cable, and bow string are free and loose ready to be worked on.

2. The portable, compact, collapsible, adjustable, archery crossbow press of claim 1, wherein two limb clamp assemblies each include a flexible cord attachable to the flexible connector.

3. A portable, compact, collapsible, adjustable, archery crossbow press for high poundage crossbows which have a rifle frame with an elongate channel, transverse limbs with cams or wheels, outer surfaces and outer ends, wheels, dampers, a tension cable and a bow string, the bow press comprising:

a) two limb clamp assemblies each with two outer arms connected by a dog bone linkage having a turnbuckle thereby the limb clamp assemblies are adjustable in width as to be adaptable to fit a variety of crossbow models and manufacturers of crossbows, each limb clamp assembly being adapted to releasably capture one of the outer surfaces, ends and cams of the transverse limbs of the crossbow:

b) a flexible connector adjustable in length being adapted to connect to the two limb clamp assembles just above the rifle frame along the elongate channel;

c) a safety hook block with a hook adapted to fit within the elongate channel of the crossbow rearwardly of the crossbow string and is further adapted to be anchored to the rifle frame and the hook releasably captures the flexible connector; and d) a mechanical cocking device attachable to the flexible connector to pull the flexible connector rearwardly along the elongate channel until the hook of the safety hook block securely captures and holds the flexible connector in place as the cams or wheels, dampers, tension cable, and bow string are free and loose ready to be worked on.

4. The portable, compact, collapsible, adjustable, archery crossbow press of claim 3, wherein the outer arm includes a bent elbow end adapted to capture one of the ends of the transverse limbs.

5. The portable, compact, collapsible, adjustable, archery crossbow press of claim 3, wherein two limb clamp assemblies each include a flexible cord attachable to the flexible connector.

6. A portable, compact, collapsible, adjustable, archery crossbow press for high poundage crossbows which have a rifle frame with an elongate channel, transverse limbs with outer surfaces and outer ends, cams or wheels, dampers, a tension cable and a bow string, the bow press comprising:

a) two limb clamp assemblies each to include an outer arm with a dog bone linkage, a flexible cord and a bent elbow end adapted to capture one of the outer surfaces, ends and cams of the limbs, which are adjustable in width as to be adaptable to fit a variety of crossbow models and manufacturers of crossbows;

b) a flexible connector adjustable in length being adapted to connect to the flexible cords of the two limb clamp assembles just above the rifle-like frame along the elongate channel;

c) a safety hook block with a hook adapted to fit within the elongate channel of the crossbow rearwardly of the bow string and is further adapted to be anchored to the rifle frame and the hook releasably captures the flexible connector; and d) a mechanical cocking device attachable to the flexible connector to pull the flexible connector rearwardly along the elongate channel until the hook of the safety hook block securely captures and holds the flexible connector in place as the cams or wheels, dampers, tension cable, and bow string are free and loose ready to be worked on.

7. A portable, compact, collapsible, adjustable, archery crossbow press for high poundage crossbows which have a rifle frame with mechanical cocking device, an elongate channel, transverse limbs each with cams or wheels, outer surfaces and outer ends, dampers, a tension cable and a bow string, the bow press comprising:

a) two limb clamp assemblies each with two outer arms connected by a dog bone linkage having a turnbuckle and a bent elbow end adapted to releasably capture one of the outer surfaces, ends and cams of the transverse limbs of the crossbow;

b) a flexible connector adapted to connect to the two limb clamp assembles just above the rifle frame; and c) a slide adapted to fit within the elongate channel of the crossbow and is further adapted to releasably capture the flexible connector, the mechanical cooking device adapted to pull the flexible connector rearwardly along the elongate channel and hold it in place as the cams or wheels, dampers, tension cable, and bow string are free and loose ready to be worked on.

8. The portable, compact, collapsible, adjustable, archery crossbow press of claim 7, wherein two limb clamp assemblies each include a flexible cord attachable to the flexible connector.

9. The portable, compact, collapsible, adjustable, archery crossbow press of claim 7, wherein the flexible connector is adjustable in length.

* * * * *